US009468579B1

(12) United States Patent
Fulkerson

(10) Patent No.: US 9,468,579 B1
(45) Date of Patent: Oct. 18, 2016

(54) SAFETY WALKER

(71) Applicant: Michel Fulkerson, Scottsdale, AZ (US)

(72) Inventor: Michel Fulkerson, Scottsdale, AZ (US)

(73) Assignee: Safety Walker LLC, Scottsdale, AZ (US)

( * ) Notice: Subject to any disclaimer, the term of this patent is extended or adjusted under 35 U.S.C. 154(b) by 0 days.

(21) Appl. No.: 15/150,297

(22) Filed: May 9, 2016

Related U.S. Application Data

(60) Provisional application No. 62/173,009, filed on Jun. 9, 2015.

(51) Int. Cl.
*A61H 3/04* (2006.01)
*A61H 3/00* (2006.01)

(52) U.S. Cl.
CPC ..... *A61H 3/008* (2013.01); *A61H 3/04* (2013.01)

(58) Field of Classification Search
CPC ..... A61H 3/04; A61G 5/027; A61G 5/028
USPC ..... 280/87.021; 482/69
See application file for complete search history.

(56) References Cited

U.S. PATENT DOCUMENTS 3,488,088 A * 1/1970 Goldberg ..... A61H 3/04 297/5
3,778,052 A * 12/1973 Andow ..... A61H 3/008 135/67
4,188,966 A * 2/1980 Palmer ..... F16M 13/08 135/67
5,040,556 A 8/1991 Raines
5,058,912 A * 10/1991 Harroun ..... A61H 3/04 135/67
5,083,806 A * 1/1992 Brown ..... A47D 13/043 248/188.5
5,255,697 A * 10/1993 Grauer ..... A61H 3/04 135/67
5,476,432 A * 12/1995 Dickens ..... A61H 3/04 135/67
5,520,402 A * 5/1996 Nestor ..... A61G 5/00 280/250
6,220,620 B1 * 4/2001 Harroun ..... A61G 5/1059 280/650
7,568,712 B2 * 8/2009 Kovachi ..... A61H 3/008 280/23.1
8,720,914 B1 * 5/2014 Heath ..... A61H 3/04 135/67
9,180,064 B2 11/2015 Prather
9,278,042 B2 * 3/2016 Osterhaus ..... A61H 3/04
2003/0137119 A1 * 7/2003 Razon ..... A61H 3/008 280/87.021
2004/0002407 A1 * 1/2004 Hawkes ..... A61H 3/008 482/69
2005/0268397 A1 * 12/2005 Nativ ..... A61G 7/1015 5/86.1
2006/0254631 A1 11/2006 Mullholand
2006/0261569 A1 * 11/2006 Delhotal ..... A61G 5/00 280/87.021
2009/0242006 A1 10/2009 Warren
2014/0296039 A1 * 10/2014 Shaw ..... A61H 3/04 482/68
2015/0238381 A1 * 8/2015 Swiniarski ..... A61H 3/00 297/5
2015/0342822 A1 * 12/2015 Osterhaus ..... A61H 3/04 280/657
2016/0051427 A1 * 2/2016 Purwar ..... A61G 7/1046 482/5

* cited by examiner

*Primary Examiner* — Jeffrey J Restifo
(74) *Attorney, Agent, or Firm* — Invention To Patent Services; Alex Hobson

(57) ABSTRACT

A safety walker provides a strap that actuates to allow a person to enter into the safety walker and then raise the strap between their legs. The strap prevents ground level falls. The safety strap is actuated by a strap actuator that may pivot about a pivot attached to the movable support frame. The strap actuator may be locked into a secure position with the strap in an elevated position by a latch. The strap actuator may be coupled to a handle actuator by one or more linkages, or the strap actuator and handle actuator may be a one-piece rigid member that rotates about a single pivot on the moveable frame. A coupling member may extend between a left and right strap actuator proximal to the back end of the strap actuators and the safety strap may be attached to the coupling member.

20 Claims, 13 Drawing Sheets

SAFETY WALKER

CROSS REFERENCE TO RELATED APPLICATIONS

The Application claims the benefit of U.S. provisional patent application No. 62/173,009, entitled Rehabilitation Safety Walker filed on Jun. 9, 2015; the entirety of which is incorporated by reference herein.

BACKGROUND OF THE INVENTION

1. Field of the Invention

The invention relates to safety walkers and particularly those with a fall restraint.

2. Background

The elderly and those recuperating from an injury or surgery often require assistance to walk. Some assisted walking devices require complex harness arrangements to prevent ground level falls. Many of these harness and restraint systems require more than one person and thereby limit a person's ability to move about unassisted. Other devices require twisting and/or bending to secure a restraint which is difficult or not possible for many users. Still other assisted walking devices utilize a complete enclosure having a door or gate portion that must be opened for entry, and subsequently shut and secured to ensure the safety of the user. These closures can also be difficult to secure and operate and again may limit a person's unassisted mobility.

There exists a need for a safety walker that is easy to enter, requires no assistance to operate, requires no buckling of harnesses and effectively prevents ground level falls.

SUMMARY OF THE INVENTION

The invention is directed to a safety walker having a safety strap that is easily configured between the user's legs to prevent falling. The safety walker of the present invention incorporates a strap that is coupled to a strap actuator that pivots to lower and raise an actuating end of a safety strap. A user simply has to step into the safety walker, wherein they step over the safety strap as they enter through the back opening, and then actuate the pivoting strap mechanism to raise the back end of the safety strap up into a locked and secure position. The safety strap extends through the user's legs and thereby prevents them from falling while being non-obtrusive as they maneuver the safety walker.

An exemplary safety walker comprises a movable support frame having an opening for easy entry. An exemplary support frame has a base with a plurality of wheels to allow movement of the safety walker in any suitable direction, including forwards, backward, left, right, and rotational movement. An exemplary support frame has a front end, a left side and a right side incorporating support members that are coupled together. An exemplary support frame may have a rounded shape or may be square or rectangular in shape. The left and right sides extend back from the front end to an extended end. The space between the left and right side extended ends creates a back end opening for a user to enter the safety walker. The top support members may act as hand rails for a user to hold onto as they guide the safety walker. The top support members may be at a height suitable for a person, such as an adult person to hold onto while walking. For example, the height of the top support members may be at least about 40 cm, or at least about 50 cm, at least about 70 cm, at least about 90 cm and any range between and including the heights provided. The left and right sides and/or the left and right top support members may be parallel with each other and spaced apart to provide room for a user to enter and maneuver the safety walker. The width between the top left and right support members may be, for example, at least about 40 cm, at least about 50 cm, at least about 60 cm and any range between and including the widths provided. In an exemplary embodiment, the outer width of the safety walker is no more than about 50 cm or no more than about 60 cm to allow the safety walker to fit through doorway openings. The movable support frame may be made out of metal, plastic, composites or any other material that provides enough structural stability to support a user, such as an adult that may weigh about 150 lbs or more, about 200 lbs or more, about 250 lbs or more and even 300 lbs or more.

An exemplary safety walker comprises a pivoting strap mechanism that pivots the back actuating end of the strap up after a user has entered into the safety walker. In an exemplary embodiment, the safety strap is attached to the front end of the moveable support frame and extends back where it is attached to a strap actuator. The entry end of the strap actuator moves up and down to raise and lower the actuating end of the strap. In an entry position, the strap is proximal to the floor, and in a secure position, the strap is raised from the floor and will support a person from falling. The entry end of the strap actuator may be moved by pivoting about a pivot attached to the moveable support frame or by a linkage coupled with a handle actuator. In an exemplary embodiment, a handle actuator and strap actuator are a one-piece rigid member that pivots about a single pivot point. In another exemplary embodiment, the handle actuator is coupled to the strap actuator by a linkage, such as a flexible or rigid linkage. In this embodiment, the handle actuator may rotate about a handle actuator pivot attached to the moveable support frame and a linkage may extend from the handle actuator to the strap actuator, whereby rotation of the handle actuator moves the strap actuator. In a preferred embodiment, the pivoting strap mechanism comprises a strap actuator on opposing sides of the safety walker, a left and a right strap actuator, as described herein. This configuration may provide more rigidity and enable higher loads to be carried by the strap. A back end coupler may extend from a left and right strap actuator at the entry end, or back-end, of the strap actuators. The actuating end of the safety strap may be attached to the back end coupler. Likewise, a left and right strap actuator may comprise a front end coupler that extends between the two strap actuators proximal to the pivot end or handle end. In the entry position, the back end coupler and strap are either touching the floor or are very close to the floor to enable a person to enter and step over them with ease. In the secure position, the entry end of the strap actuator is elevated to where it is locked into the secure position by an actuator lock mechanism, such as a latch. The actuating end of the strap is now elevated off of the floor and will restrain a user in the event of a fall.

As described, in an entry position, the strap and back end coupler of the strap actuator are proximal to the floor to allow easy entry into the safety walker. For example, the safety strap and back end coupler may be no more than 7 cm off the floor, no more than about 5 cm off the floor, no more than about 3 cm of the floor and any range between and including the height off the floor provided. In an exemplary embodiment, the back end coupler is a flat support member that provides enough structural support but is low profile for ease of entry into the safety walker. Likewise, the safety strap may have a thickness that is sufficiently low profile. The safety strap may be a fabric that is woven and may have a width that is sufficient to secure a person during a fall. The width of the strap may be, for example, at least about 4 cm, at least about 5 cm, at least about 7 cm, at least about 10 cm, at least about 15 cm and any range between and including the safety strap widths provided. It is important that the safety strap not be too wide as it may become too obtrusive for a person to walk. The thickness of the safety strap may be less than about 2 cm, less than about 1 cm, less than about 0.5 cm, less than about 0.25 cm and any range between and including the thickness values provided.

As described, in a secure position, the strap actuator is locked into a forward rotation position by an actuator lock mechanism. In an exemplary embodiment, the actuator lock mechanism automatically locks the strap actuator into position. For example, a latch may be deflected by a portion of the strap actuator as it is rotated forward and then secure the strap actuator in position. A latch may secure the strap actuator by gravity or there may be a spring strap actuator mechanism that ensures a firm retention of the strap actuator in a secure position. In an exemplary embodiment, an actuator lock mechanism secures a front end coupler of the strap actuator in position. An exemplary actuator lock mechanism may have a simple actuator release mechanism, such as a lever or bar or handle that is actuated to release the strap actuator from the lock, or latch. In an exemplary embodiment, a actuator release is a handle that is coupled with the actuator lock mechanism and actuating the release enables the strap actuator to rotate back to allow the user to exit from the safety walker. The back end of the strap actuator will drop freely to the floor and the person may simply back out of the safety walker.

An exemplary pivoting strap mechanism may comprise one or more dampers to ensure the back end of the strap actuators, or the back end coupler, does not fall too rapidly to the floor, thereby damaging the floor and/or the safety walker. A damper, comprising a cylinder and piston, for example, may be coupled between the strap actuator and the movable support frame.

In an exemplary embodiment, a safety walker comprises a left and a right strap actuator that are coupled together proximal the front or near the handles by a front end coupler and are coupled together proximal the back end, by a back end coupler. A connected support structure greatly increases the rigidity and load bearing capability of the pivoting strap mechanism. When a left and right strap actuator are incorporated, the back end coupler may be a thinner material to facilitate ease of entry into the safety walker.

In an exemplary embodiment, the safety strap is attached to a support member of the front end of the movable support frame and is attached to the back end coupler. The strap may be attached to these support members by being looped around them, tied to them or otherwise secured. The length of the strap is fixed and extends between the front end support member and the back end coupler. The strap may be loose and droop between these two support members but the length of the strap does not require adjustment, such as tightening or shortening, to provide effective support when a person falls. In an exemplary embodiment, the back end of the safety strap, the actuating end, is simply raised up by rotation of the strap actuator upon entry.

An exemplary safety walker may comprise a wheel lock mechanism to allow a user to lock the wheel whenever desired, or particularly upon entry and/or exit. A wheel lock actuator may be positioned in an ergonomic location to allow easy engagement and disengagement of the wheel lock. A lever may be positioned along one of the sides of the moveable support structure, such as up along a top support member. A user may simply rotate the wheel lock actuator to engage the wheel lock. A cable or other linking mechanism may couple the wheel lock actuator with the wheel lock.

The summary of the invention is provided as a general introduction to some of the embodiments of the invention, and is not intended to be limiting. Additional example embodiments including variations and alternative configurations of the invention are provided herein.

BRIEF DESCRIPTION OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
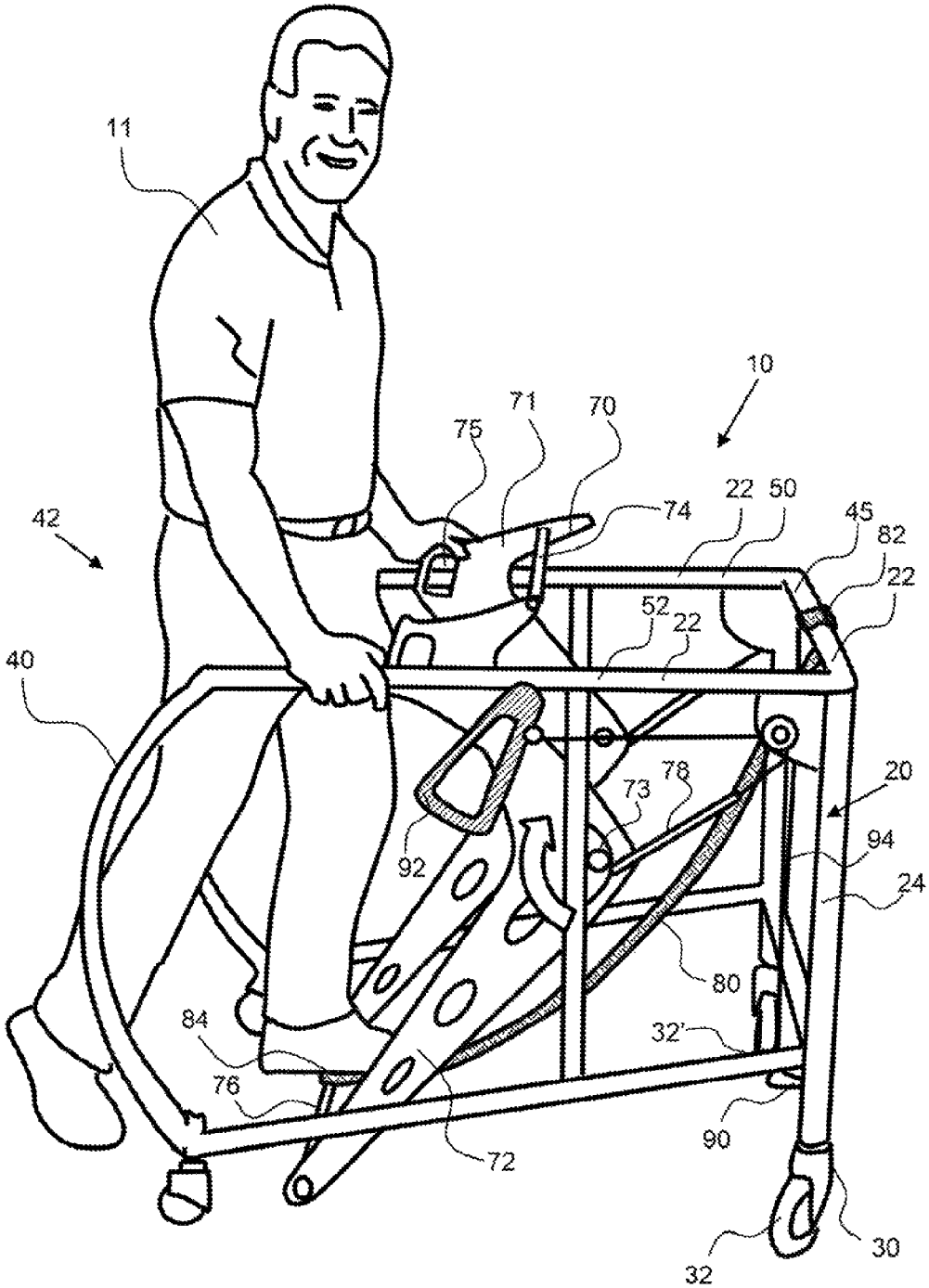
FIG. 1 shows a side view of an exemplary safety walker with a person entering the back end opening and stepping over the back end coupler of the pivoting safety strap mechanism.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale; some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

In cases where the present specification and a document incorporated by reference include conflicting and/or inconsistent disclosure, the present specification shall control.

Certain exemplary embodiments of the present invention are described herein and are illustrated in the accompanying figures. The embodiments described are only for purposes of Illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications and improvements are within the scope of the present invention.

DEFINITIONS

As shown in FIG. 1, a person 11 is entering an exemplary safety walker 10 through the back end opening 42 and stepping over the back end coupler 76 of the pivoting safety strap mechanism 70. The person 11 enters and straddles the safety strap 80. The safety walker 10 comprises a movable support frame 20 having a front end 45, left side 50, right side 52 and back end 40. A plurality of frame support members 24 are coupled together to create the moveable support frame 20. The support frame has wheels 32 coupled to the base 30 that enables the support frame to move freely in any direction, as described herein. The top portions of the left and right sides as well as the front end 45 of the support frame provide a hand rail 22 for a person to hold onto and guide the safety walker. There is an opening in the back end to allow a person to easily enter the safety walker. A strap 80 has a length from the fixed end 82, attached to the front end 45, to the actuating end 84, attached to the back end coupler 76 of the pivoting strap mechanism 70. The pivoting strap mechanism has a left strap actuator 71 and a right strap actuator 72 that are rigid members that pivot or rotate about the pivot 73 secured to the movable support frame, as indicated by the large arrow around the pivot 73. The safety strap extends from the front end 45 of the support frame 20 to the back end coupler that extends between the left and right strap actuators proximal the back end of the actuators. As shown, the back end coupler and actuating end of the strap are resting on the floor when the safety walker is in an entry position. The wheel lock actuator 90 is configured to lock the wheels 32 from moving. A cable 94 extends from the wheel lock actuator 92 to engage a break or wheel lock 90 on the wheels, 32, 32'.

Figure 2:
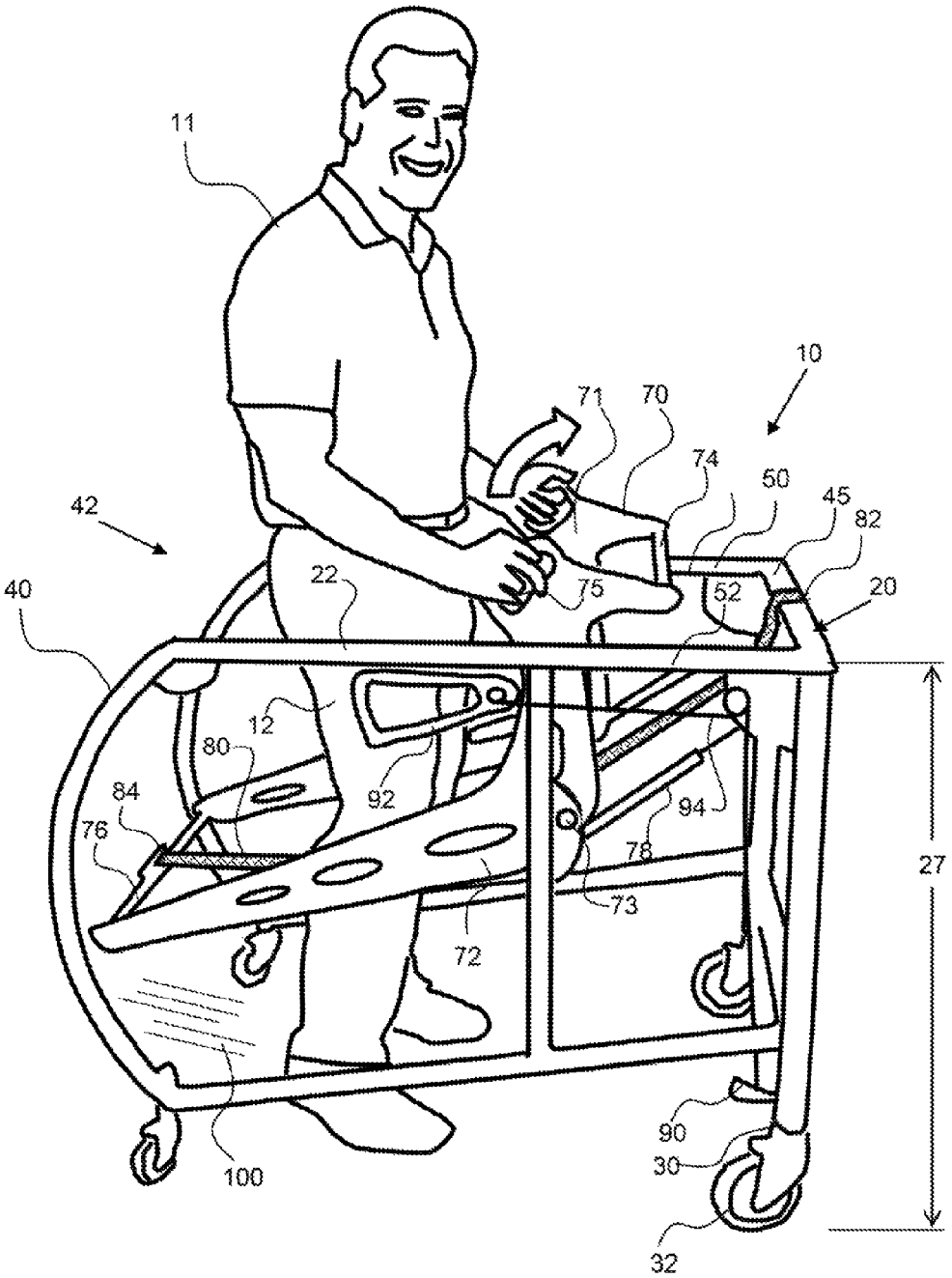
FIG. 2 shows a side view of an exemplary safety walker with a person actuating the pivoting safety strap mechanism forward to raise the actuating end of the safety strap.

As shown in FIG. 2, the person 11 is now within the exemplary safety walker 10 and the strap 80 is extending through the person's legs 12. The pivoting strap mechanism is rotated up from the entry position but is not locked into a secure position. The actuating end 84 of the safety strap 80 as well as the back end coupler 76 are raised off of the floor 100. The left and right strap actuators have handles 75 for the person to hold onto as they pivot the actuators into a secured position, shown in FIG. 3. Dampers 78 are coupled between the left and right strap actuators and the support frame 20 to prevent the strap actuators from dropping and damaging the floor. The height 27 of the safety walker and the height of the top support members or hand rails 22 is suitable for a person to use for assistance as they maneuver the safety walker, as described herein.

Figure 3:
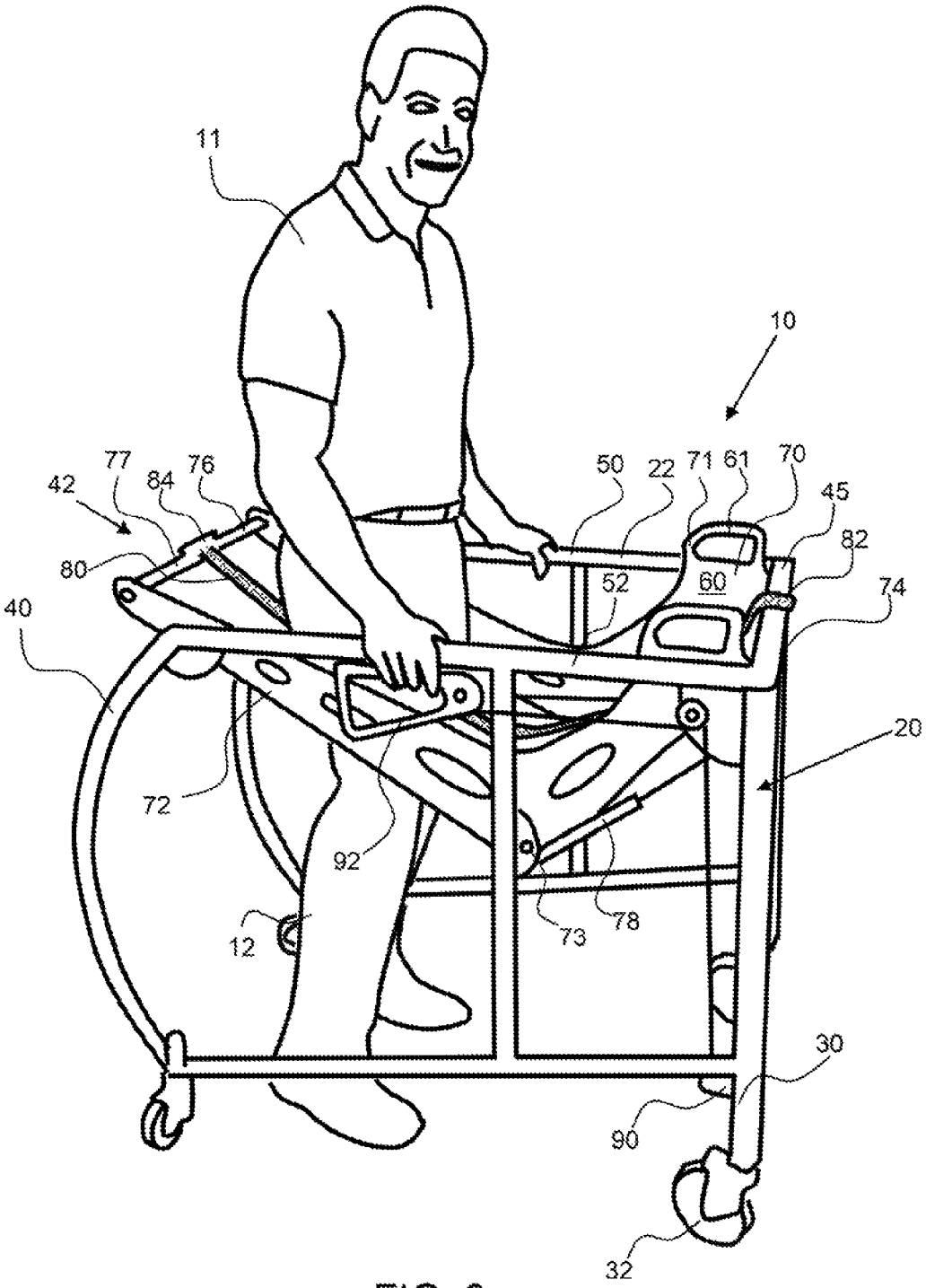
FIG. 3 shows a side view of an exemplary safety walker with a person secured in the safety walker with the pivoting safety strap mechanism locked into a secure position and the safety strap extending from a front end through the person's crotch to the actuating end.

As shown in FIG. 3, the exemplary safety walker 10 is now in a secure position or orientation with the strap actuators 71, 72 pivoted forward until they are locked into position by a latch, not shown. The person can now move the safety walker with the safety strap 80 extending from the front end 45, through their legs 12, to the back end coupler 76 that is now raised off the ground and secured in an elevated position. The wheel lock actuator has been rotated to free the wheel lock and thereby allow free movement of the safety walker.

Figure 4:
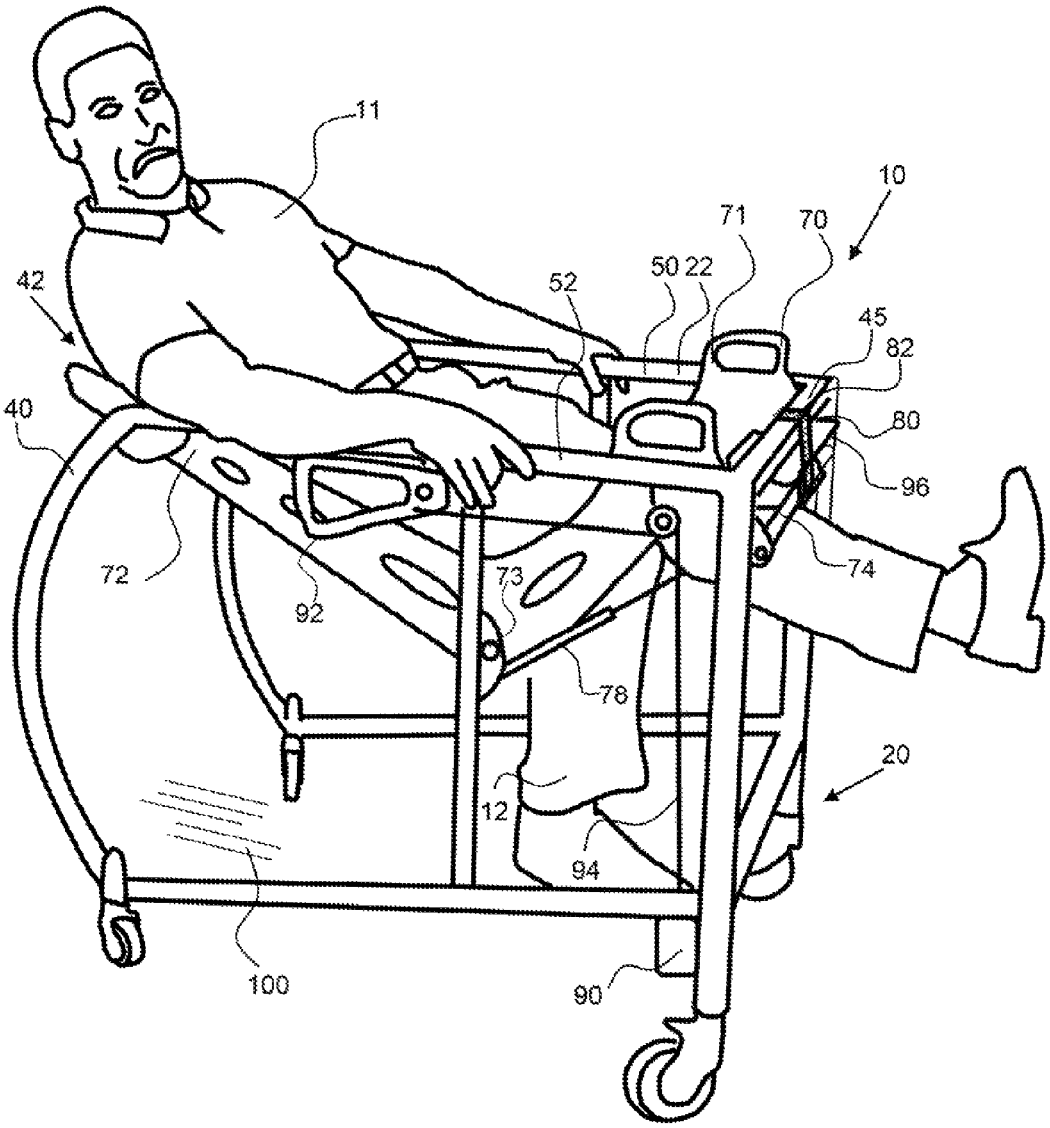
FIG. 4 shows a side view of an exemplary safety walker with a person being secured by the strap after falling.

As shown in FIG. 4, the person 11 has fallen and has been caught by the safety strap extending through their legs 12. The person cannot fall as the strap extends through their crotch and the hand rails 22 prevent them from falling to either side.

Figure 5:
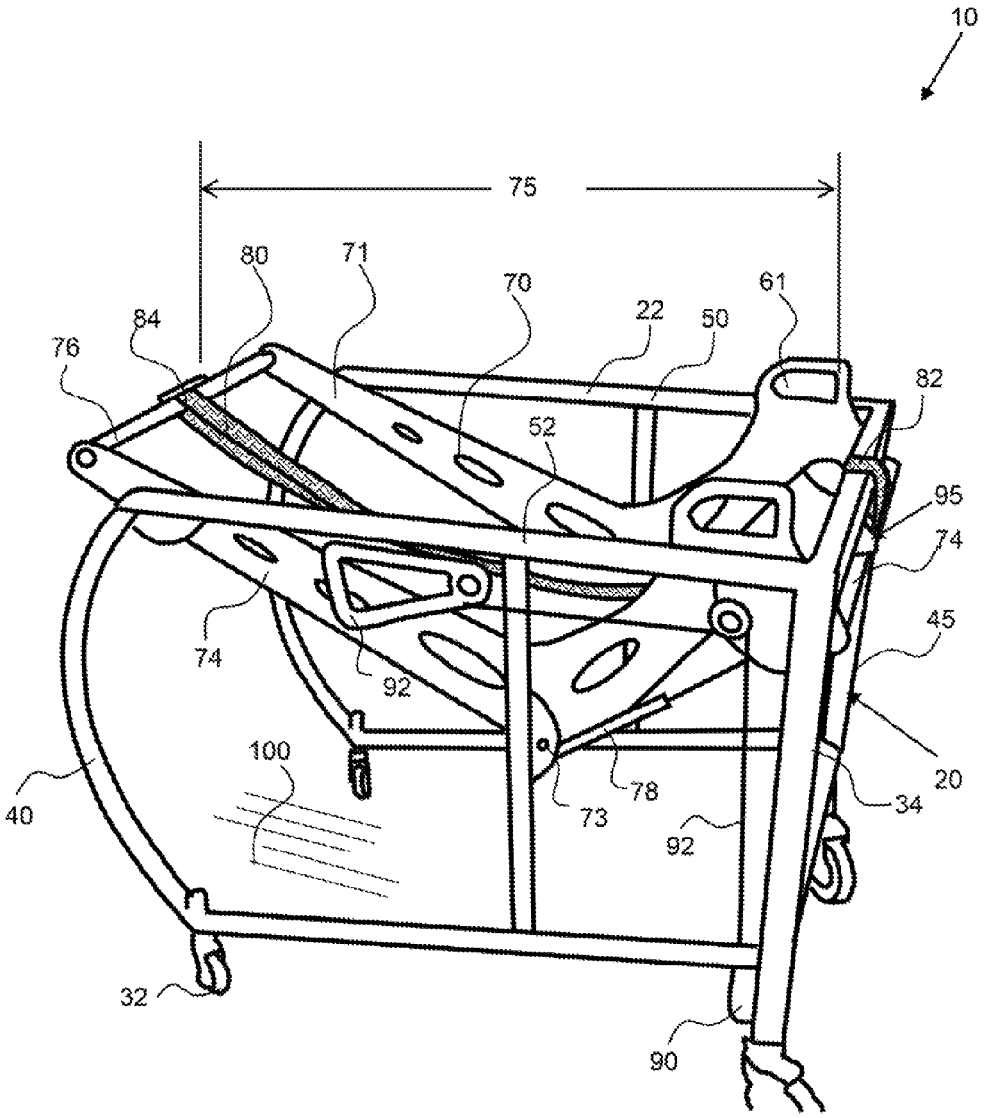
FIG. 5 shows a side view of an exemplary safety walker with the pivoting safety strap mechanism in a secured position.

As shown in FIG. 5, an exemplary safety walker 10 has the pivoting strap mechanism 70 in a secured position. In this exemplary embodiment, the front end coupler 74, a bar extending between the left and right strap actuators, is retained in position by an actuator lock mechanism 95. A latch of the actuator lock mechanism may deflect as the strap actuator is rotated forward to engage with the front end coupler to retain it in position. As shown in FIG. 5, the safety strap 80 is elevated from the floor. The front end 82 is secured to the support frame 20 and the back end, or actuating end 84, is coupled with the back end coupler 76. The length of the strap actuator 75 from the back end coupler to the handle 61 is shown.

Figure 6:
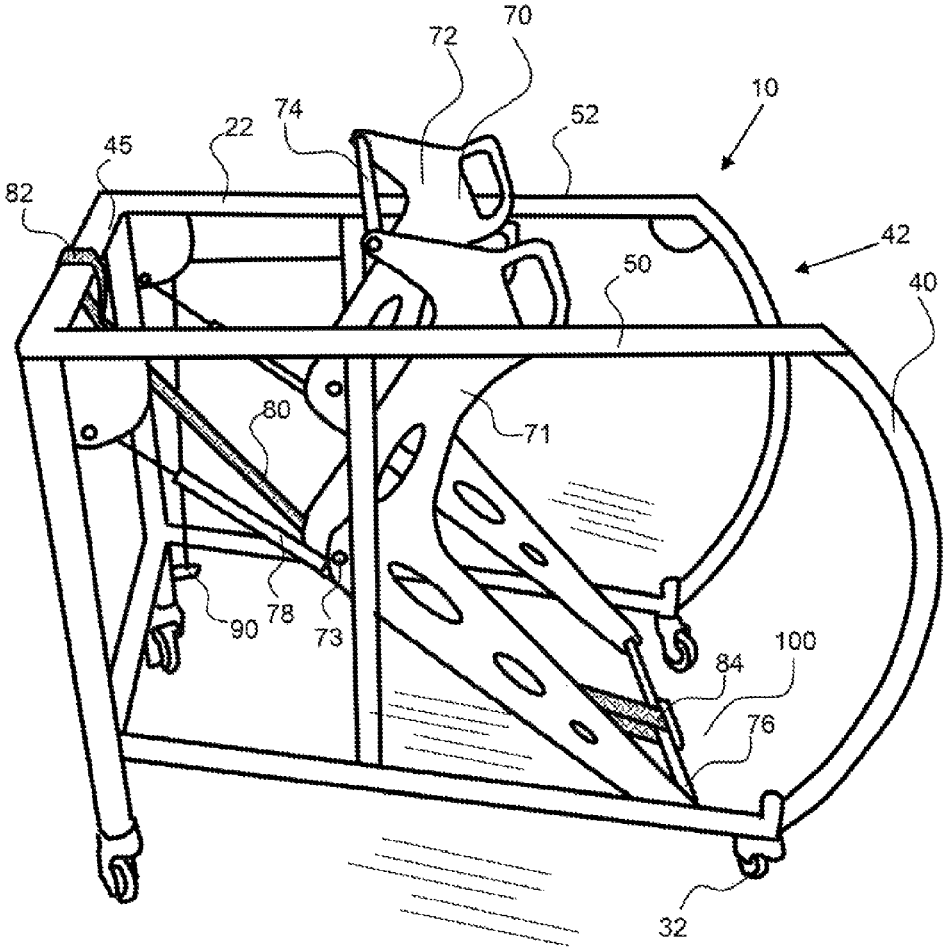
FIG. 6 shows a side view of an exemplary safety walker with the pivoting safety strap mechanism in entry position, wherein the actuating end of the strap and back end coupler are resting on the floor.

As shown in FIG. 6, an exemplary safety walker 10 has the pivoting safety strap mechanism 70 in an entry position, wherein the actuating end 84 of the safety strap 80 and the back end coupler 76 are resting on the floor 100. This allows a person to easily step over the back end coupler and straddle the safety strap 80. The person can then actuate the pivoting safety strap mechanism 70 by rotating it forward and about the pivot 73 until it latches automatically into a secure position. The person can then freely move with the walker in any position by grasping the hand rails 22 and pushing the safety walker 10.

Figure 7:
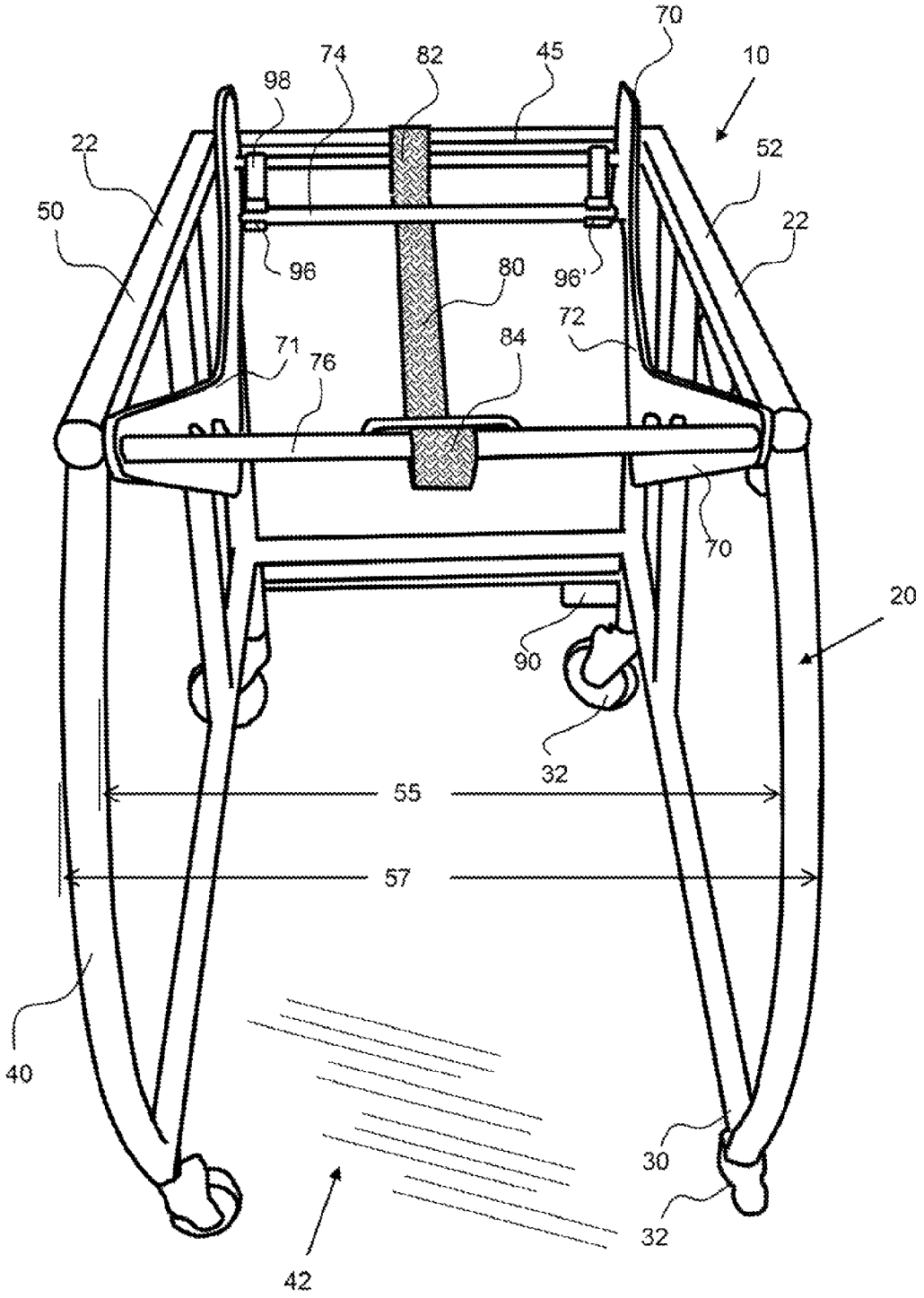
FIG. 7 shows a back end view of an exemplary safety walker with the pivoting safety strap mechanism in a secured position.

As shown in FIG. 7, an exemplary safety walker 10 is in a secure position with the pivoting safety strap mechanism 70 retained in a secured position by the latch 96. The latch has two extensions from a latch actuator 98 that extends around the front end coupler 74 when it is pushed down into the secure position. The latch extensions may be spring loaded or may fall into place to secure the actuator by gravity. The width 55 between the left and right sides, or entry opening width, as well as the outer width 57 of the safety walker, or the movable support frame, are shown.

Figure 8:
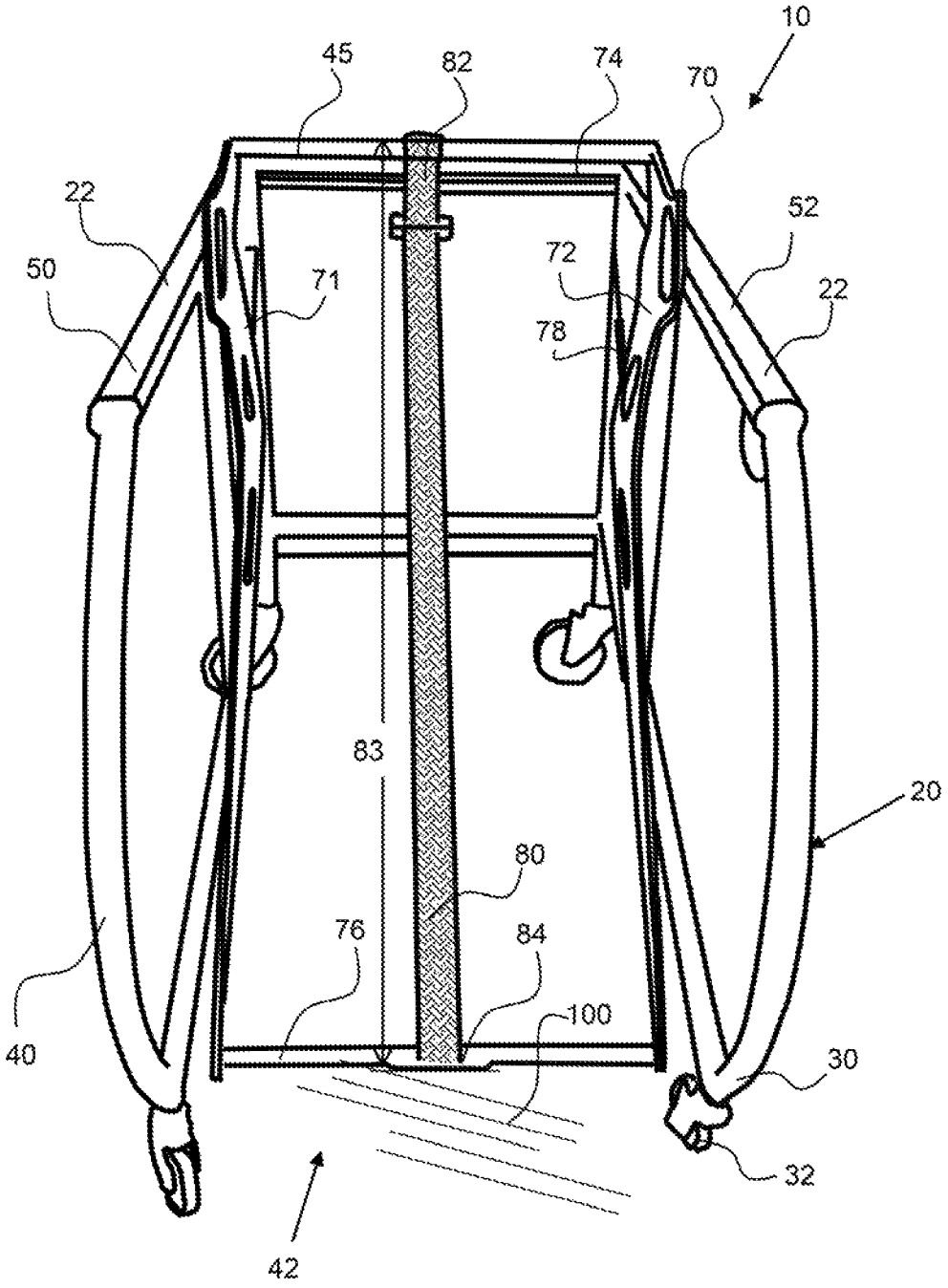
FIG. 8 shows a back end view of an exemplary safety walker with the pivoting safety strap mechanism in entry position, wherein the actuating end of the strap and back end coupler are resting on the floor.

As shown in FIG. 8, an exemplary safety walker 10 is in an entry position with the pivoting safety strap mechanism 70 dropped down. The actuating end of the strap 84 is secured to the back end coupler 76 that is resting on the floor 100. The back end coupler may have a flat profile making it easy for a person to step over the back end coupler and into the safety walker. The length 83 of the safety strap 80 is shown. As described herein, the safety walker may provide effective fall prevention without requiring adjustment of the strap length between the front end 45 and the back end coupler 76.

Figure 9:
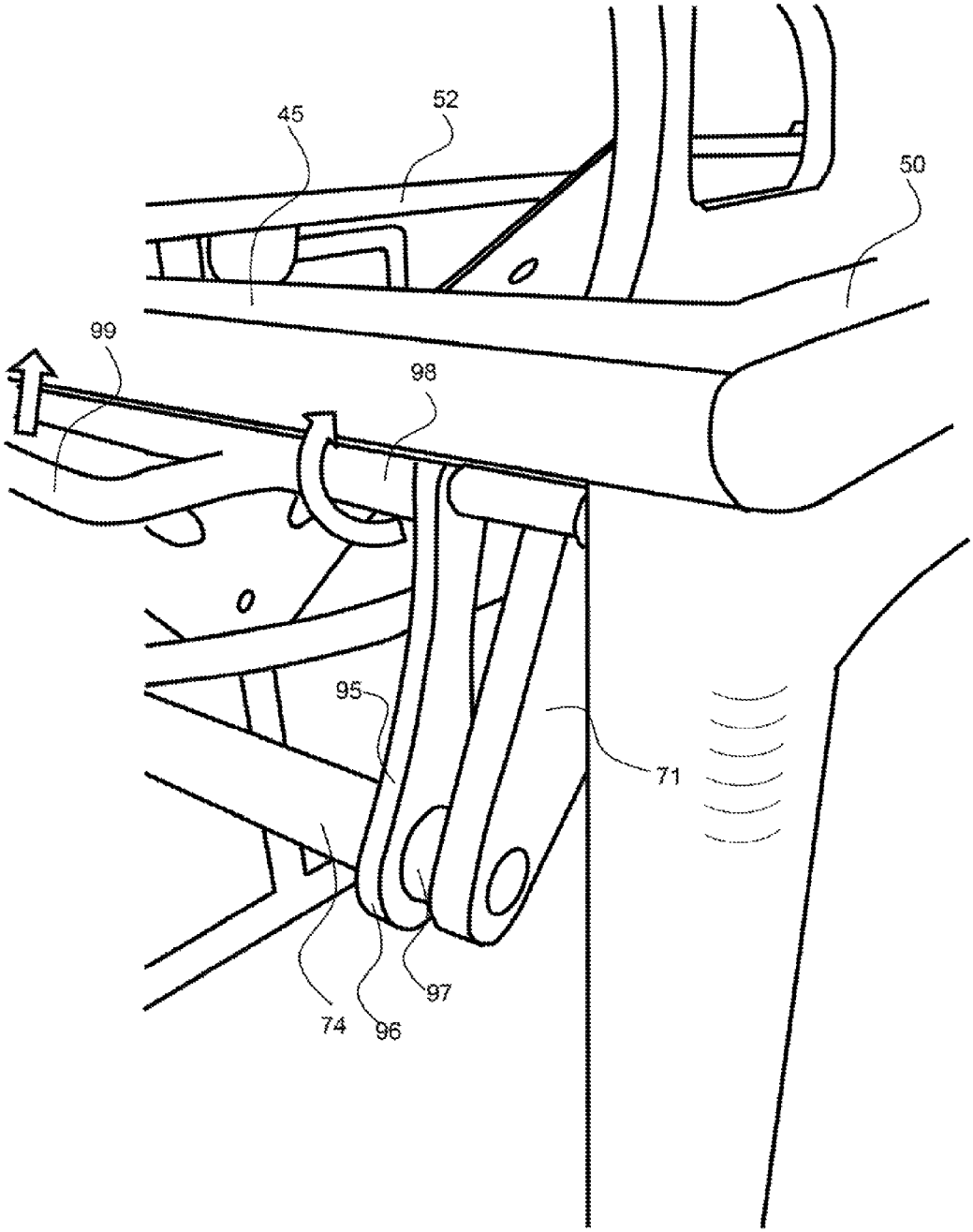
FIG. 9 shows a perspective view of the latch actuator and latch that secures the pivoting strap mechanism in a secure position.

As shown in FIG. 9, an exemplary actuator lock mechanism 95 comprises a latch actuator 98 and latch 96 that secure the front end coupler 74 into a secure position. The front end coupler will hit the latch 96 and deflect it until the opening in the latch 97 seats around the front end coupler 74. A latch actuator 99 allows a person to release the latch by pulling up on the latch actuator which rotates the latch or latches from engagement with the front end coupler.

Figure 10:
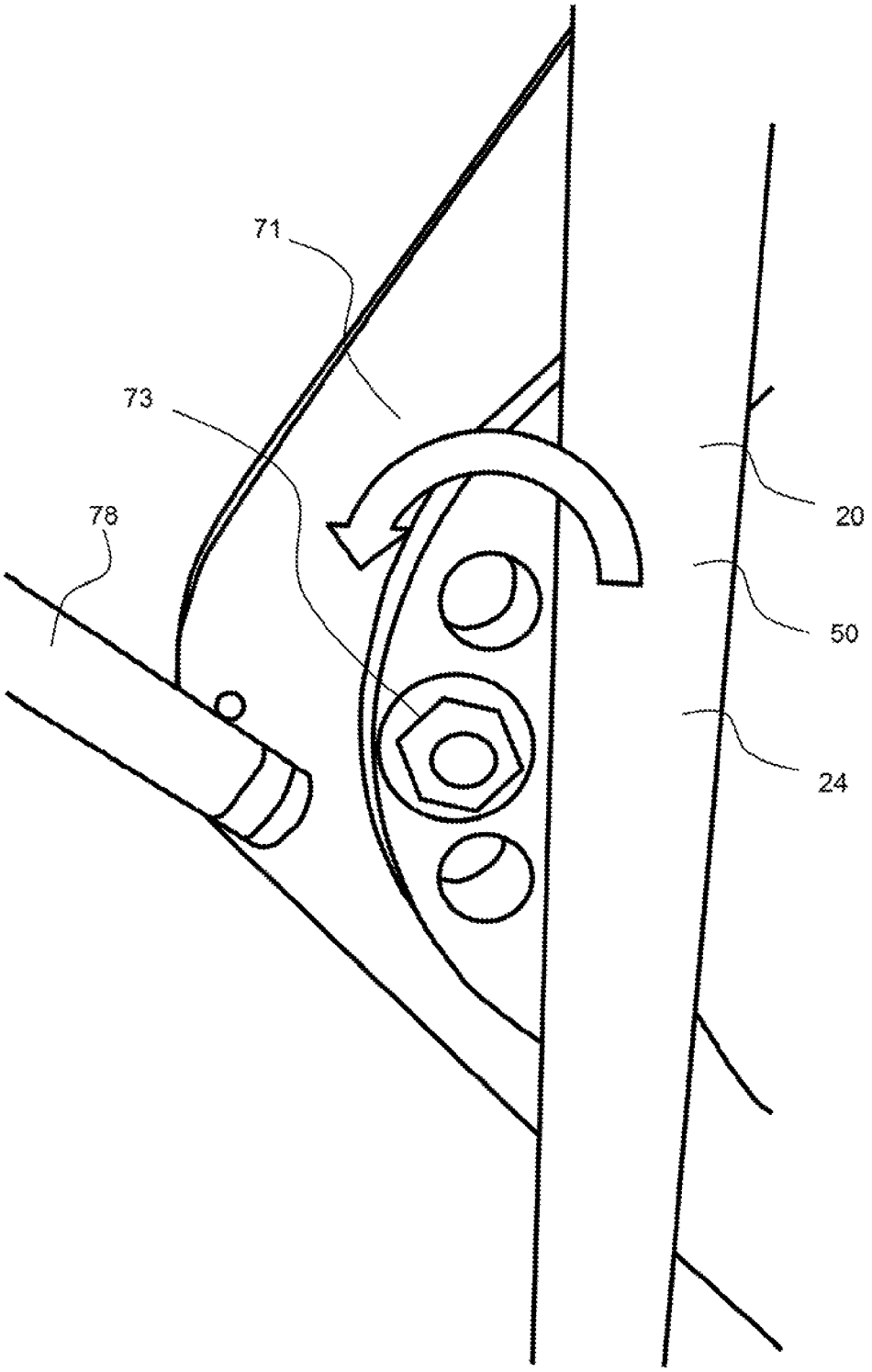
FIG. 10 shows a perspective view of a portion of the left side of the support frame having a pivot that couples with the left strap actuator.

As shown in FIG. 10, a damper 78 is attached to the left strap actuator 71. The left strap actuator 71 is coupled to the movable support frame 20 on a left side 50 support member 24. The strap actuator 71 is configured to rotate about the pivot 73 forward and backward. Forward rotation to engages the strap actuator lock mechanism and secures the strap actuator in a secure position. Backward rotation positions the actuating end of the strap and the back end coupler proximal to the floor.

Figure 11:
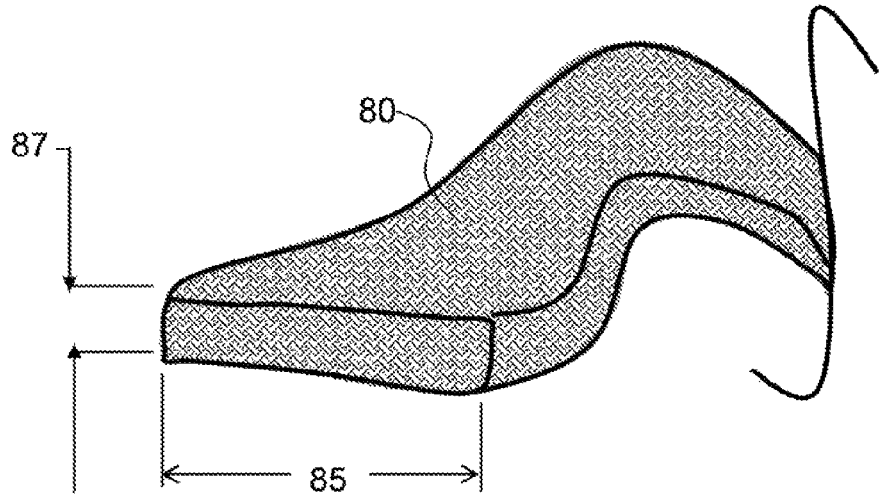
FIG. 11 show s perspective cross section of an exemplary strap.

As shown in FIG. 11, an exemplary strap 80 has a width 85 and thickness 87, as described herein. The width of the strap may be suitably narrow to reduce interference with walking and sufficiently wide enough to secure the person in the event of a fall. As described herein, the thickness of the strap may be sufficiently thin to allow easy entry into the safety walker.

Figure 12:
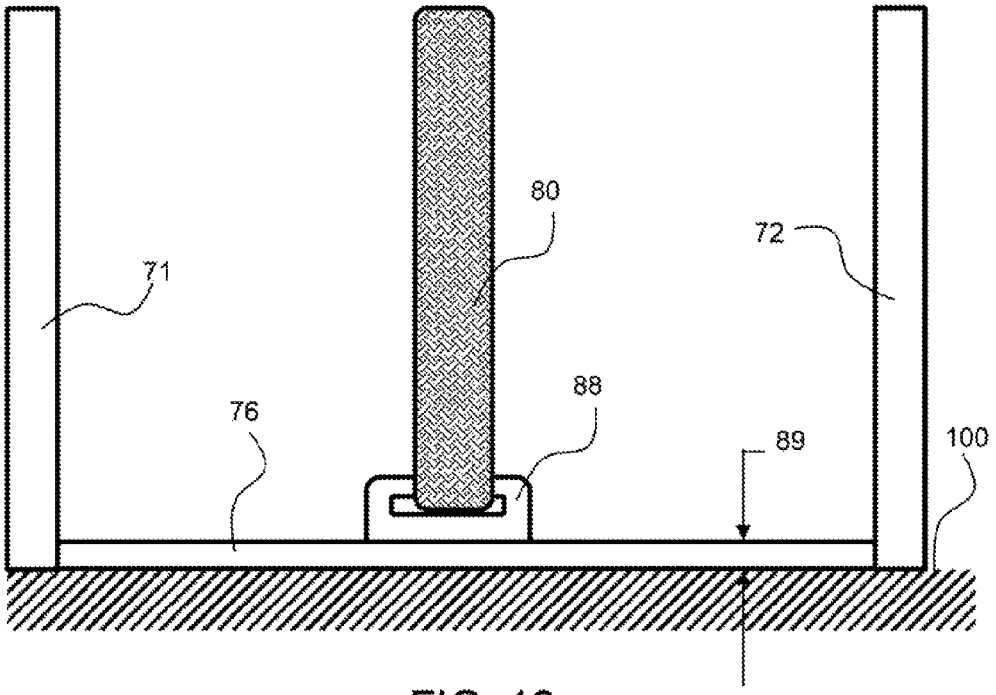
FIG. 12 shows the back view of a portion of the safety walker in an entry position with the back end coupler on the floor.

As shown in FIG. 12, the safety strap 80 may be coupled with an extension portion 88 of the back end coupler 76 to reduce the height of the back end coupler from the floor when in an entry position. The back end coupler may have a thickness 89 that is sufficiently small to allow easy entry into the safety walker.

Figure 13:
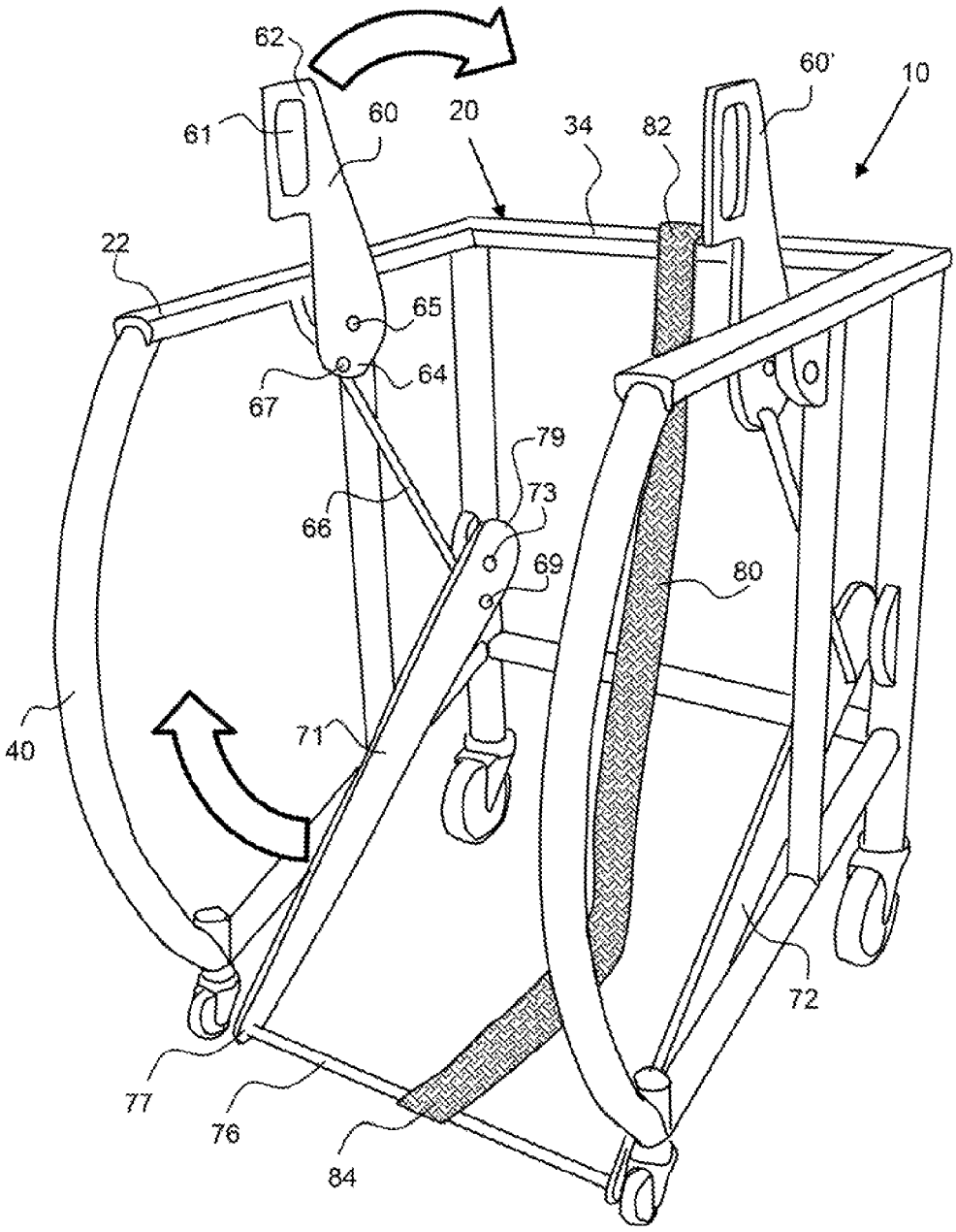
FIG. 13 shows a back-end perspective view of an exemplary safety walker with a handle actuator coupled to a strap actuator by a linkage and the entry end of the strap actuator in a down position, or proximal to the floor.

As shown in FIG. 13, of an exemplary safety walker 10 is configured with a handle actuator 60 coupled to a strap actuator 71 by a linkage 66. The handle actuator 60 has a handle 61, and a length from a handle end to a pivot end 64. The handle actuator pivots or rotates about the handle actuator pivot 65 and thereby moves the linkage 66. The linkage 66 may be a rigid linkage, such as a rod, or strut, or may be a flexible linkage, such as a cable, or wire, for example. The linkage has a length and extends from the handle-end 67 to the strap-actuator end 69. Actuation of the handle actuator 60 about the handle actuator pivot 65, as indicated by the bold arrow, pulls the strap actuator 71 up through the linkage. The linkage is attached to the handle actuator at an offset distance from the handle actuator pivot and from the strap actuator pivot 73. The strap actuator has a length and extends from the pivot end to the entry end 77. The linkage pulls the strap actuator and causes it to rotate about the strap actuator pivot 73, as indicated by the bold arrow, thereby raising the actuating end of the strap. The strap 80 extends from the front end 34 of the movable support frame 20 to the actuating end 84 that is coupled to the back-end coupler 76. The back-end coupler extends between the left strap actuator 71 and right strap actuator 72.

Figure 14:
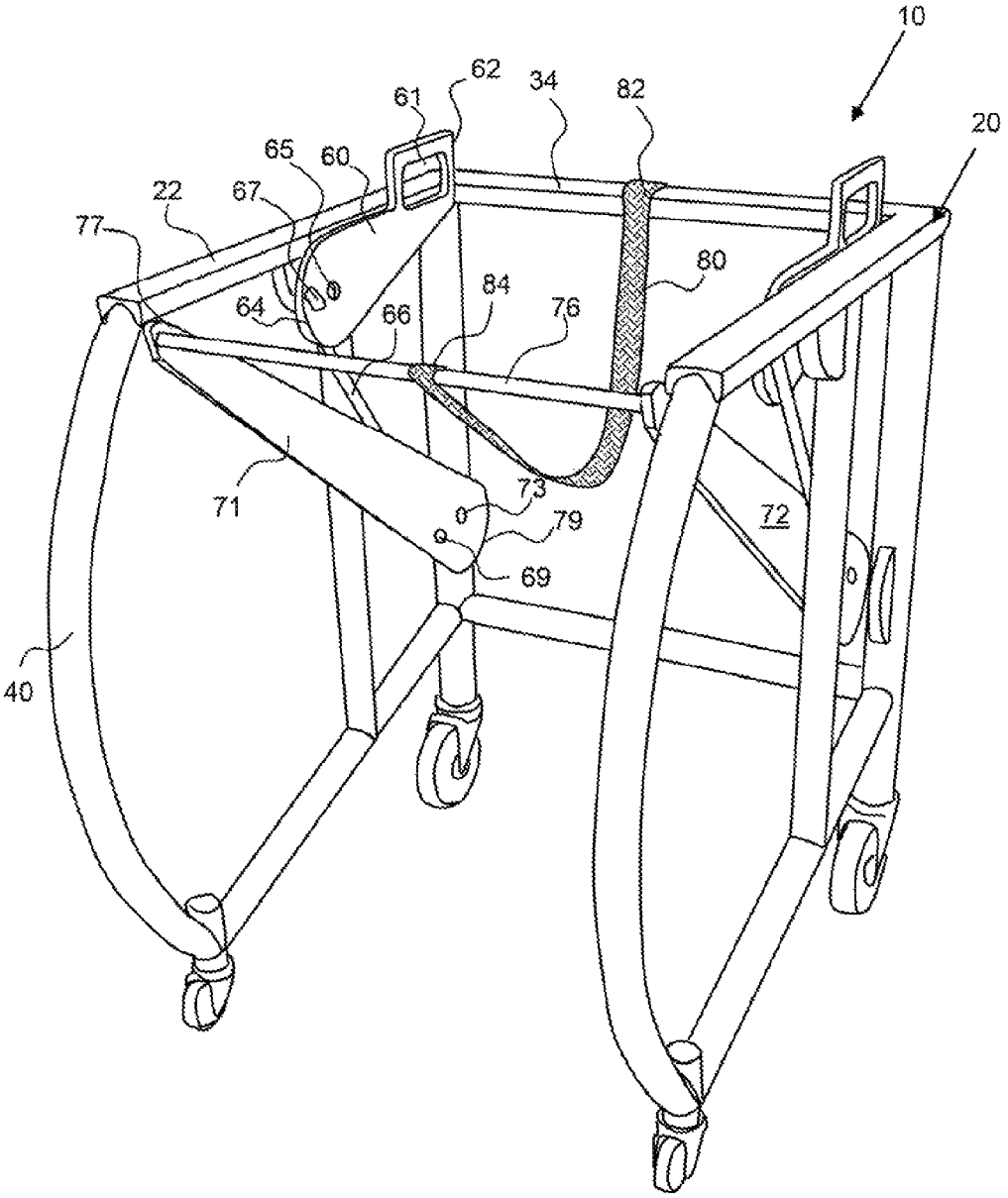
FIG. 14 shows a back-end perspective view of an exemplary safety walker with a handle actuator coupled to a strap actuator by a linkage and the entry end of the strap actuator in an up position, or in a secure position.

As shown in FIG. 14, the exemplary safety walker 10 shown in FIG. 13 is now configured in a secure position, wherein the actuating end 84 of the strap 80 is elevated and locked into place. The handle actuator 60 has been rotated forward toward the front end 34 of the movable frame 20 and is locked into position. This secures the strap actuator in position.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A safety walker comprising:

a) a movable support frame comprising:

i) a base having a plurality of wheels;

ii) a front end having a front support;

iii) a back end having an opening for entry into the movable support frame;

iv) a left side having a left side support having an attached end to the front support, and an extended end;

v) a right side having a right side support having an attached end to the front support, and an extended end;

wherein the left and right side supports extend back from the front support and wherein the extended ends of the left and right supports form said opening for entry into the movable support frame;

b) a pivoting strap mechanism comprising:

i) a strap actuator having an entry end that is configured to move up and down;

ii) a safety strap having a length from a fixed end to an actuating end;

iii) a handle actuator coupled with the strap actuator and configured to move the strap actuator up and down;

wherein the fixed end of the strap is attached to the front support and the actuating end is attached to the entry end of the strap actuator;

wherein the strap actuator has a secure position and an entry position;

wherein in said entry position the entry end of the strap actuator is configured proximal to a floor;

wherein in said secure position the entry end of the strap actuator is elevated up from said floor and thereby raises the actuating end of the safety strap.

2. The safety walker of claim 1, further comprising a linkage between the strap actuator and the handle actuator;

wherein actuation of the handle actuator moves the linkage to move the entry end of the strap actuator up and down.

3. The safety walker of claim 2, wherein the handle actuator rotates about a handle actuator pivot, and the strap actuator rotates about a strap actuator pivot and wherein the linkage is attached to the handle actuator at an offset distance from the handle actuator pivot and is attached to the strap actuator at an offset distance from the strap actuator pivot.

4. The safety walker of claim 2, wherein the linkage is a flexible linkage.

5. The safety walker of claim 2, wherein the linkage is a rigid linkage.

6. The safety walker of claim 1, wherein the handle actuator and strap actuator are a one-piece rigid member that is configured to pivot about a pivot fixed to the movable support frame.

7. The safety walker of claim 1, further comprising an actuator lock mechanism and release;

wherein the lock mechanism retains the strap actuator in the secure position; and wherein the release mechanism releases the strap actuator from the secure position and allows the entry end to pivot down toward said floor.

8. The safety walker of claim 7, wherein the actuator lock mechanism comprises a latch, wherein the latch engages with a portion of the handle actuator to secure said strap actuator in said secure position.

9. The safety walker of claim 1, wherein the movable support frame is rectangular in shape having a front end that is substantially perpendicular to the left and right sides.

10. The safety walker of claim 1, further comprising a damper coupled between the movable support frame and the strap actuator to slow the drop of the entry end of the strap actuator when the strap actuator moves from said secure position to said entry position.

11. The safety walker of claim 1, wherein the pivoting strap mechanism comprises:

a) a first strap actuator that extends along the left side of the movable support frame;

b) a second strap actuator that extends along the right side of the movable support frame;

c) a back end strap coupler that extends between and is attached proximal to the entry end of the first and second strap actuators;

d) wherein the actuating end of the safety strap is attached to the back end strap coupler.

12. The safety walker of claim 11, wherein the pivoting safety strap mechanism comprises a front coupler that extends between and is attached proximal to the handle end of the first and second strap actuators.

13. The safety walker of claim 11, further comprising an actuator lock mechanism and release;

wherein the lock mechanism retains the strap actuator in the secure position; and wherein the release mechanism releases the strap actuator from the secure position and allows the entry end to pivot down toward said floor.

14. The safety walker of claim 1, further comprising a wheel lock mechanism comprising a wheel lock actuator.

15. A safety walker comprising:

a) a movable support frame comprising:

i) a base having a plurality of wheels;

ii) a front end having a front support;

iii) a back end having an opening for entry into the movable support frame;

iv) a left side having a left side support having an attached end to the front support, and an extended end;

v) a right side having a right side support having an attached end to the front support, and an extended end;

wherein the left and right side supports extend back from the front support and wherein the extended ends of the left and right supports form said opening for entry into the movable support frame;

b) a pivoting strap mechanism comprising:

i) a safety strap having a length from a fixed end to an actuating end;

ii) a first strap actuator that extends along the left side of the movable support frame;

iii) a second strap actuator that extends along the right side of the movable support frame;

wherein both the first and second strap actuators have a length from a handle end and an entry end;

iv) a back end strap coupler that extends between and is attached to the entry end of the first and second strap actuators;

v) a front coupler that extends between and is attached to the handle end of the first and second strap actuators;

wherein the actuating end of the safety strap is attached to the strap coupler;

vi) a pivot configured between the front and back end of the movable support frame;

wherein the fixed end of the strap is attached to the front support and the actuating end is attached to the entry end of the strap actuator;

wherein the strap actuator pivots around said pivot;

wherein the strap actuator has a secure position and an entry position;

wherein in said entry position the entry end of the strap actuator is configured proximal to a floor;

wherein in said secure position the entry end of the strap actuator is elevated from said floor and thereby raises the actuating end of the safety strap; and wherein the movable support frame is rectangular in shape having a front support that is substantially perpendicular to the left and right supports.

16. The safety walker of claim 15, further comprising a wheel lock mechanism comprising a wheel lock actuator.

17. The safety walker of claim 16, wherein the wheel lock mechanism comprises a cable that extends from the lock actuator to the wheel lock.

18. A safety walker comprising:

a) a movable support frame comprising:

i) a base having a plurality of wheels;

ii) a front end having a front support;

iii) a back end having an opening for entry into the movable support frame;

iv) a left side having a left side support having an attached end to the front support, and an extended end;

v) a right side having a right side support having an attached end to the front support, and an extended end;

wherein the left and right side supports extend back from the front support and wherein the extended ends of the left and right supports form said opening for entry into the movable support frame;

b) a pivoting strap mechanism comprising:

i) a strap actuator having an entry end that is configured to move up and down;

ii) a safety strap having a length from a fixed end to an actuating end;

iii) a handle actuator coupled with the strap actuator and configured to move the strap actuator up and down;

iv) a linkage between extending between the handle actuator and the strap actuator;

wherein the fixed end of the strap is attached to the front support and the actuating end is attached to the entry end of the strap actuator;

wherein the strap actuator has a secure position and an entry position;

wherein in said entry position the entry end of the strap actuator is configured proximal to a floor;

wherein in said secure position the entry end of the strap actuator is elevated from said floor and thereby raises actuating end of the safety strap up;

wherein the handle actuator rotates about a handle actuator pivot, and the strap actuator rotates about a strap actuator pivot and wherein the linkage is attached to the handle actuator at an offset distance from the handle actuator pivot and attached to the strap actuator at an offset distance from the strap actuator pivot;

c) an actuator lock mechanism and release;

wherein the lock mechanism retains the strap actuator in the secure position; and wherein the release mechanism releases the strap actuator from the secure position and allows the entry end to pivot down toward said floor;

wherein the actuator lock mechanism comprises a latch, wherein the latch engages with a portion of the handle actuator to secure said strap actuator in said secure position.

19. The safety walker of claim 18, wherein the linkage is a flexible linkage.

20. The safety walker of claim 18, wherein the linkage is a rigid linkage.

* * * * *